US006751852B2

(12) United States Patent
Malsbury et al.

(10) Patent No.: US 6,751,852 B2
(45) Date of Patent: Jun. 22, 2004

(54) MODULAR PRESSURE VESSEL UNHEADING AND CONTAINMENT SYSTEM

(75) Inventors: Allen S. Malsbury, Parsippany, NJ (US); Ronald T. Myszka, Bethlehem, PA (US); Mark Hassert, Summit, NJ (US)

(73) Assignee: Foster Wheeler USA Corporation, Clinton, NJ (US)

( * ) Notice: Subject to any disclaimer, the term of this patent is extended or adjusted under 35 U.S.C. 154(b) by 236 days.

(21) Appl. No.: 09/852,622

(22) Filed: May 11, 2001

(65) Prior Publication Data

US 2002/0166862 A1 Nov. 14, 2002

(51) Int. Cl.[7] ..... B23P 21/00

(52) U.S. Cl. ..... 29/722; 29/426.5; 29/402.04; 202/241; 202/252; 202/262

(58) Field of Search ..... 29/722, 426.5, 29/402.04; 202/241, 242, 252, 262

(56) References Cited

U.S. PATENT DOCUMENTS

| | | | | |
|---|---|---|---|---|
| 2,580,700 | A | 1/1952 | Phillips | |
| 3,801,472 | A | 4/1974 | Kemmetmueller | |
| 4,186,854 | A | 2/1980 | Teske | 222/185 |
| 4,726,109 | A | 2/1988 | Malsbury et al. | 29/402.08 |
| 4,820,384 | A | 4/1989 | Pechacek | 202/245 |
| 4,960,358 | A | 10/1990 | DiGiacomo et al. | 414/684.3 |
| 5,221,019 | A | 6/1993 | Pechacek et al. | 220/315 |
| 5,290,072 | A | 3/1994 | Pechacek | 285/97 |
| 5,500,094 | A | 3/1996 | Fruchtbaum et al. | 202/241 |
| 5,581,864 | A | 12/1996 | Rabet | 29/426.3 |
| 5,947,674 | A | 9/1999 | Malsbury et al. | 414/216 |
| 6,039,844 | A | 3/2000 | Malik | 202/227 |
| 6,066,237 | A | 5/2000 | Kindersley | 202/242 |
| 6,085,929 | A | 7/2000 | Malsbury et al. | 220/328 |
| 6,113,745 | A | 9/2000 | Maitland et al. | 202/262 |
| 6,223,925 | B1 | 5/2001 | Malsbury et al. | |

*Primary Examiner*—David P. Bryant
(74) *Attorney, Agent, or Firm*—Fitzpatrick, Cella, Harper & Scinto

(57) ABSTRACT

An unheading and containment system for unheading and heading a pressure vessel includes an unheading apparatus for removing a cover from a pressure vessel in an unheading operation and a modular enclosure, mechanism to substantially enclose the cover during the unheading operation. The unheading apparatus includes a cover removably secured to the pressure vessel, a lock plate cooperating with the cover, and a cover moving mechanism capable of moving the cover vertically and laterally.

36 Claims, 17 Drawing Sheets

MODULAR PRESSURE VESSEL UNHEADING AND CONTAINMENT SYSTEM

FIELD OF THE INVENTION

This invention relates to a pressure vessel, and, more particularly, to a modular containment system for removing and replacing a cover of a pressure vessel. This invention is particularly applicable to removing and replacing bottom covers of coke drums.

BACKGROUND OF THE INVENTION

The processing of crude oil into gasoline, diesel fuel, lubricants, and the like, as well as many other petroleum-refining operations, produces byproducts that have very little value. However, the value of these byproducts can be substantially increased when they are heated for a long enough time at a temperature sufficient to cause what is known as "destructive distillation." During the process of destructive distillation, a portion of the byproducts is converted to usable hydrocarbon products. The remainder is transformed into a solid carbon product called "coke." The temperature at which destructive distillation normally occurs is about 900 degrees F. Generally, an industrial furnace is used to incur destructive distillation.

Conventionally, a large pressure vessel known as a coke drum is provided at a furnace outlet for a sufficient amount of time to allow for a complete destructive distillation reaction. A typical coke drum is a large, vertical metal vessel with top and bottom closures. The actual size, shape, and configuration of the coke drum, however, can vary considerably from one installation to another. The bottom closure typically includes a relatively large and heavy removable cover that is secured to the drum by dozens of bolts. Disengagement and reengagement of the removable cover, known as unheading and heading, respectively, can be quite labor intensive, given the mass of the cover and the numerous bolts that hold it in place.

During the refining process, petroleum byproducts are deposited in the coke drum as a hot liquid slurry. Typically, the slurry enters the drum through an opening in the bottom closure. Lighter hydrocarbons, the products of destructive distillation, flow out the top of the coke drum while heavier material remains inside the drum.

After a coke drum is filled to the desired capacity and the flow of slurry into the drum ceases, the drum is cooled. This typically involves injecting steam into the drum to strip useful hydrocarbon vapors from the solid material and then injecting water into the drum to further cool the coke. The liquid mass remaining in the coke drum is substantially full of coke that, as it cools, hardens into solid material. This solid coke must be removed from the drum before the drum can be reused. The process of removing coke from a drum is referred to as "decoking."

A typical decoking process involves several steps. First, any water remaining in the drum is drained through piping to allow for removal of the cover from the bottom closure of the drum. In a hydraulic operation, as opposed to a manual operation, the cover is supported by a hydraulic lifting mechanism to detension the joint. Next, the cover must be unlocked from the coke drum and disengaged in a controlled manner by manipulating the bolts attaching the cover to a flange on the drum. The cover then is lowered by the hydraulic mechanism. As can be appreciated, unheading a coke drum can be a time consuming process. After unheading is complete, the coke in the drum is cut out of the drum by high pressure water jets. The operation is reversed to resecure the cover on the drum.

To help streamline the unheading process, oil refineries frequently use automated unheading devices. Such unheading devices typically are provided at the lower end of the coking drums for automatic and semi-automatic heading and unheading and are capable of being remotely operated. An example of a known remotely operated unheading device for a coking drum is disclosed in U.S. Pat. No. 4,726,109 to Malsbury et al. In that patent, a platform device is provided beneath the coking drum for lowering the header unit (or cover), moving the header unit laterally to one side, and tipping it to facilitate cleaning of the header unit.

Other examples of remotely-operated removable closures are shown in U.S. Pat. Nos. 4,820,384, 5,290,072, and 5,221,019. For example, in the '384 patent a remotely-operated vessel cover assembly includes a cover which can be attached to a flange surrounding an opening-in the vessel. When the cover is raised into position, a series of connector pins fits through corresponding holes in a force ring and keyhole-shaped holes in a lock ring. The lock ring then is rotated so that heads of the connector pins are locked behind the lock ring. Fluid pressure then is applied to a force actuator, pressurizing inner and outer annular rings, which expand to pre-stress the pins and the cover. A ramp ring then is rotated until a series of ramps thereon firmly contacts a complementary series of ramps on the cover. The force actuator is then depressurized. According to this patent, the angle of inclination of the ramps is sufficiently shallow that friction between the ramp ring and the cover prevents slippage.

Automatic and semi-automatic unheading devices that confine the flow of discharge from the drum to a storage arrangement by means of a chute are also known in the art. For example, U.S. Pat. No. 6,039,844 to Malik discloses a containment system for coke drums including a safety shield, a removable cover, a plurality of actuators, and a system to vertically position the shield. The Malik patent also discloses an inner shield telescopically disposed within the safety shield to channel discharge from the coke drum to a switch deck floor.

Despite the current state of the art, there is a need in the art for a system that reliably contains and controls the entire unheading and heading process. There is a further need for such a system that is conducive to remote actuation. There is a still further need for such a system that is modular in construction so as to be easily transported and removably disposed around the bottom closure of a coke drum. There is also a need in the art for a system that confines drum discharge when the cover is disengaged from the flange and simplifies the process of delivering the discharge to an unheading deck floor.

SUMMARY OF THE INVENTION

Accordingly, it is a principal object of the present invention to provide an improved unheading and containment system for a pressure vessel.

According to one aspect of the present invention, an unheading and containment system is provided having an unheading apparatus for removing a cover from a pressure vessel in an unheading operation, and a modular enclosure mechanism. The unheading apparatus includes a cover removably secured to the pressure vessel, a lock plate that cooperates with the cover, and a cover moving mechanism capable of moving the cover vertically and laterally. The modular enclosure mechanism includes a chassis that substantially encloses the cover during the unheading operation. The unheading apparatus may also include a flange mounted to a headed end of the pressure vessel and having a plurality of fasteners cooperating with the lock plate to secure the cover to the pressure vessel when the cover is brought into aligned contact with the flange.

According to another aspect of the present invention, a pressure vessel unheading and containment system is provided having a removable cover closing a pressure vessel bottom outlet and a chassis substantially enclosing an area between the bottom outlet and a support surface, with the cover contained within the enclosed area in an open position and a closed position. The system may also include a flange mounted to the pressure vessel at the bottom outlet and a lock plate cooperatively connected to the cover. The flange and the lock plate cooperate to secure the cover to the bottom outlet.

According to yet another aspect of the present invention, a pressure vessel unheading and containment system is provided having an unheading means for unheading a cover from a bottom outlet of the pressure vessel and an enclosure means for substantially enclosing the unheading operation performed by said unheading means. The system may also include a cover moving means adapted to move the cover vertically and laterally.

The unheading means may comprise a removable cover, a lock plate cooperating with the cover, and a cover moving mechanism capable of moving the cover vertically. The system may also include a flange mounted to the pressure vessel near its bottom outlet and having a plurality of fasteners cooperating with the lock plate to secure the cover to the pressure vessel.

These and other objects, features, and advantages of the present invention will be more clearly understood from the following discussion with reference to the following drawings, in which like reference numerals refer to like elements throughout.

BRIEF DESCRIPTION OF THE DRAWINGS

This invention will be further described with reference to the following drawings, in which.

DETAILED DESCRIPTION OF THE PREFERRED EMBODIMENTS

Figure 1:
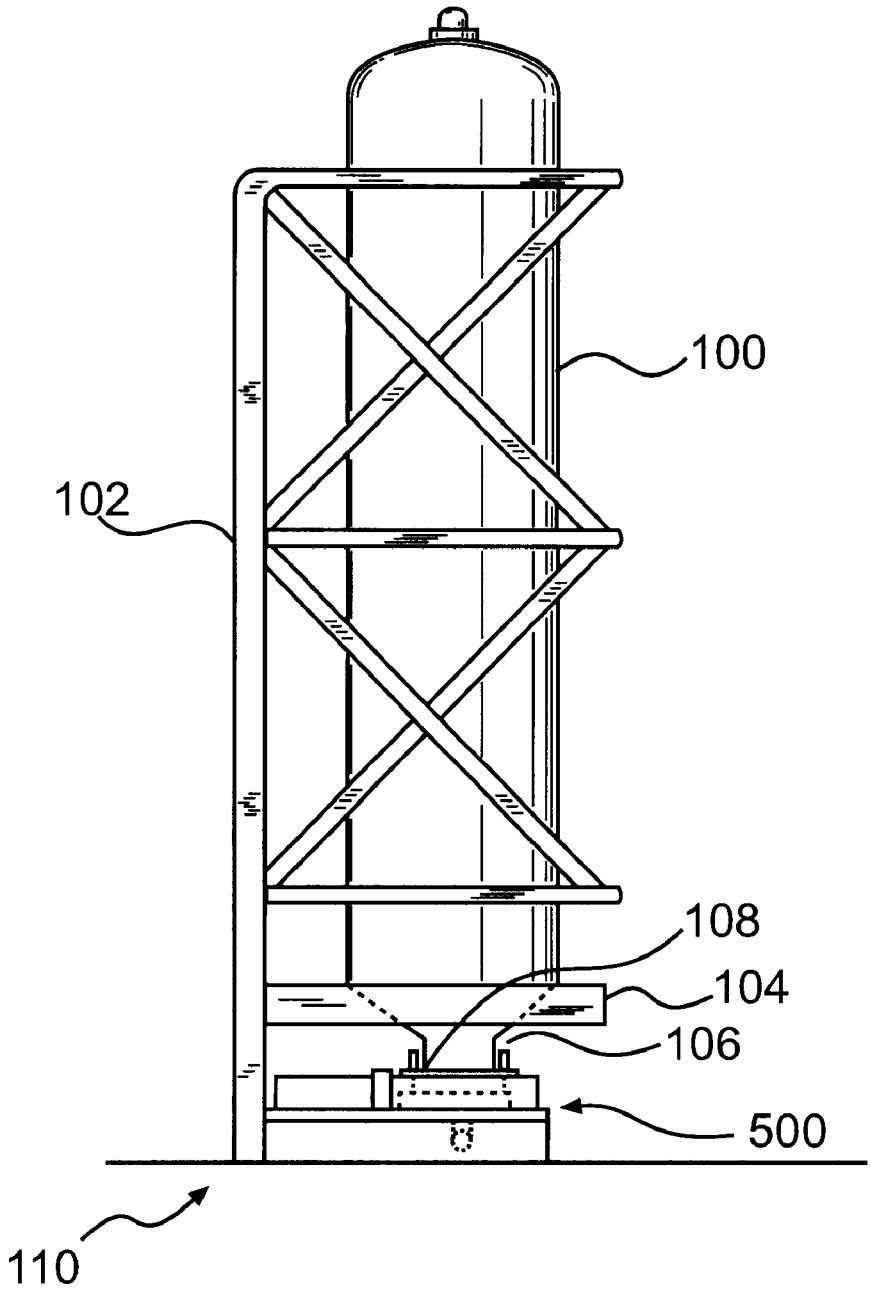
FIG. 1 shows a vertically-oriented coke drum with a removable cover and a chassis of the present invention provided at a lower end of the drum.

As generally shown in FIG. 1, a vertically-oriented coking drum 100 is supported by a support structure 102 that includes a support deck 104 provided near the lower end of the drum 100. The coking drum 100 has a conical lower portion 106 narrowing toward an open end 108. Shown beneath the coking drum 100 is a chassis 500 which, as described below, encloses components for heading and unheading the drum 100.

Figure 2:
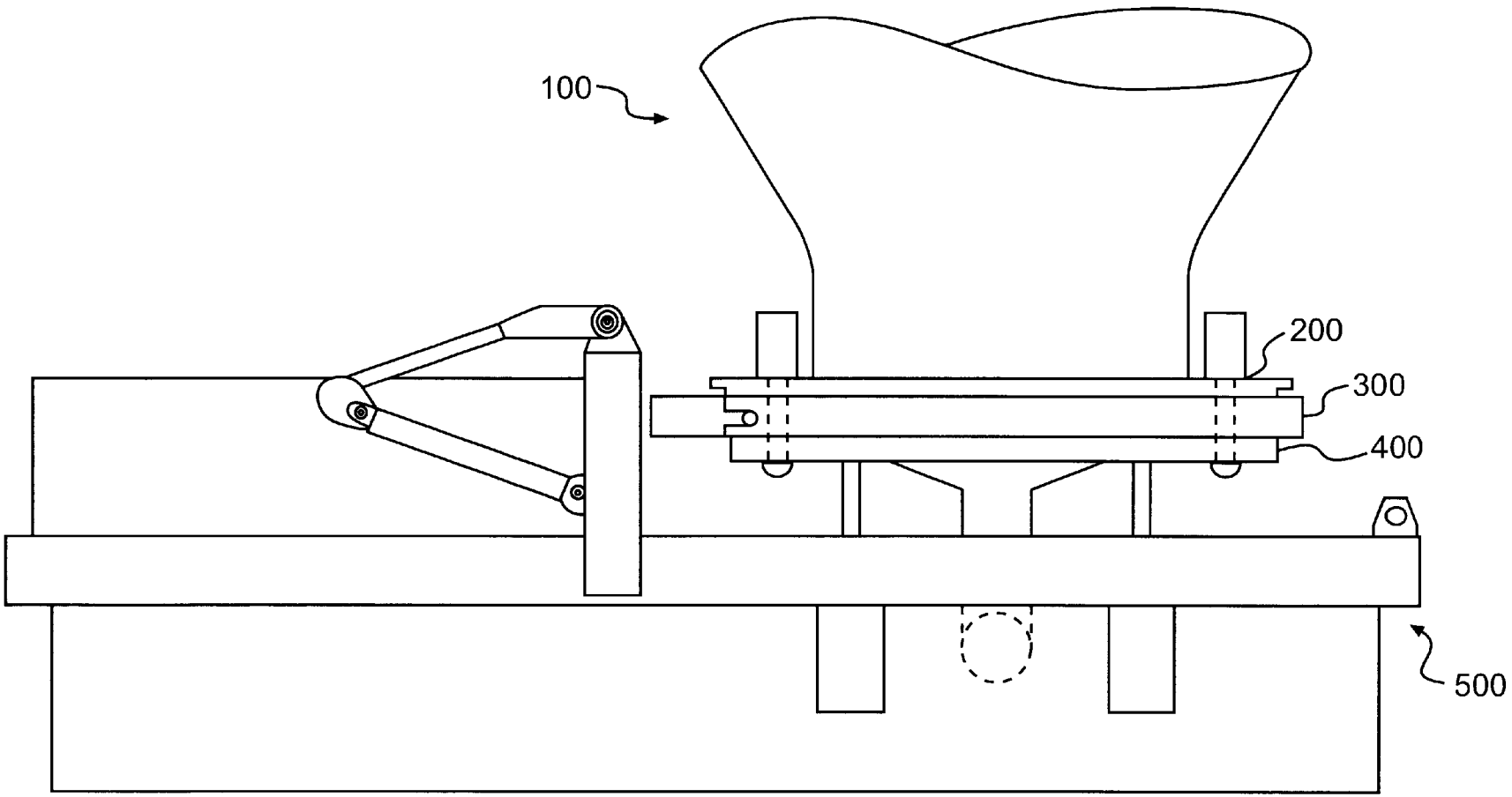
FIG. 2 shows an elevation view of a headed end of the coke drum.

Referring to FIG. 2, the drum 100 is shown headed by three primary components which cooperate with each other in a manner to be described below: a flange 200; a removable cover 300; and a lock plate 400. The flange 200 is secured to the drum 100 by welding, for example. The cover 300 and the lock plate 400 are removably secured to the flange 200 in a manner discussed in detail below. The flange 200, the cover 300, and the lock plate 400 are enclosed within the chassis 500, a top casing 504 of which is removed in FIG. 2 for illustration purposes, but can be seen in FIG. 7.

Figure 3:
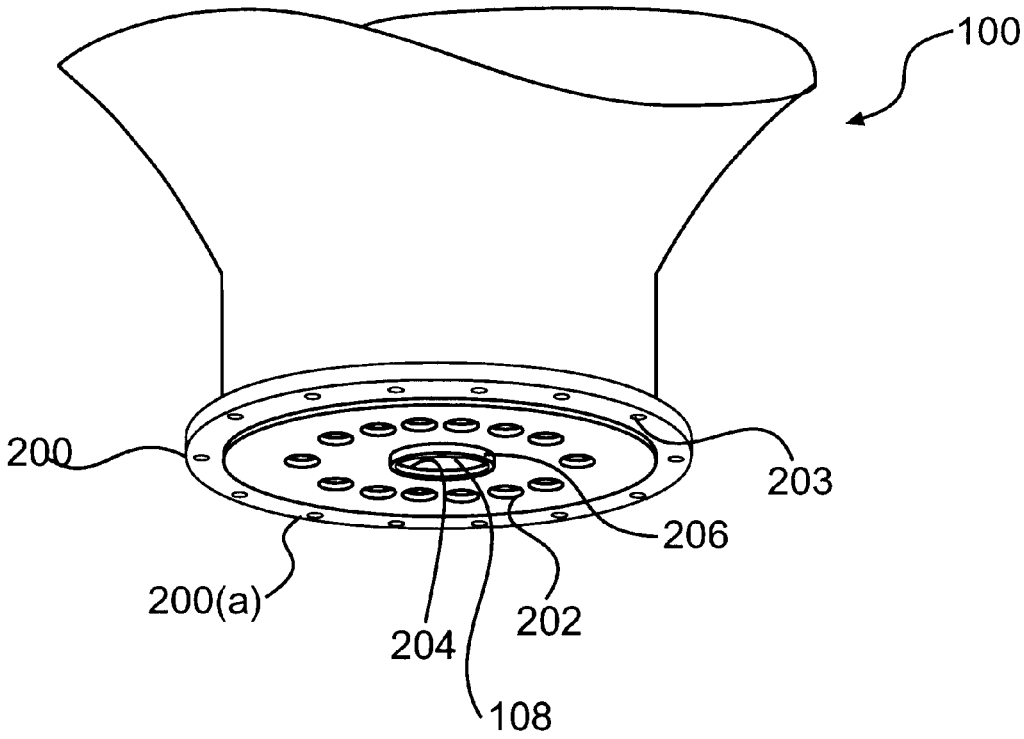
FIG. 3 shows a perspective view of a flange of the present invention attached to a lower end of the drum.
Figure 8:
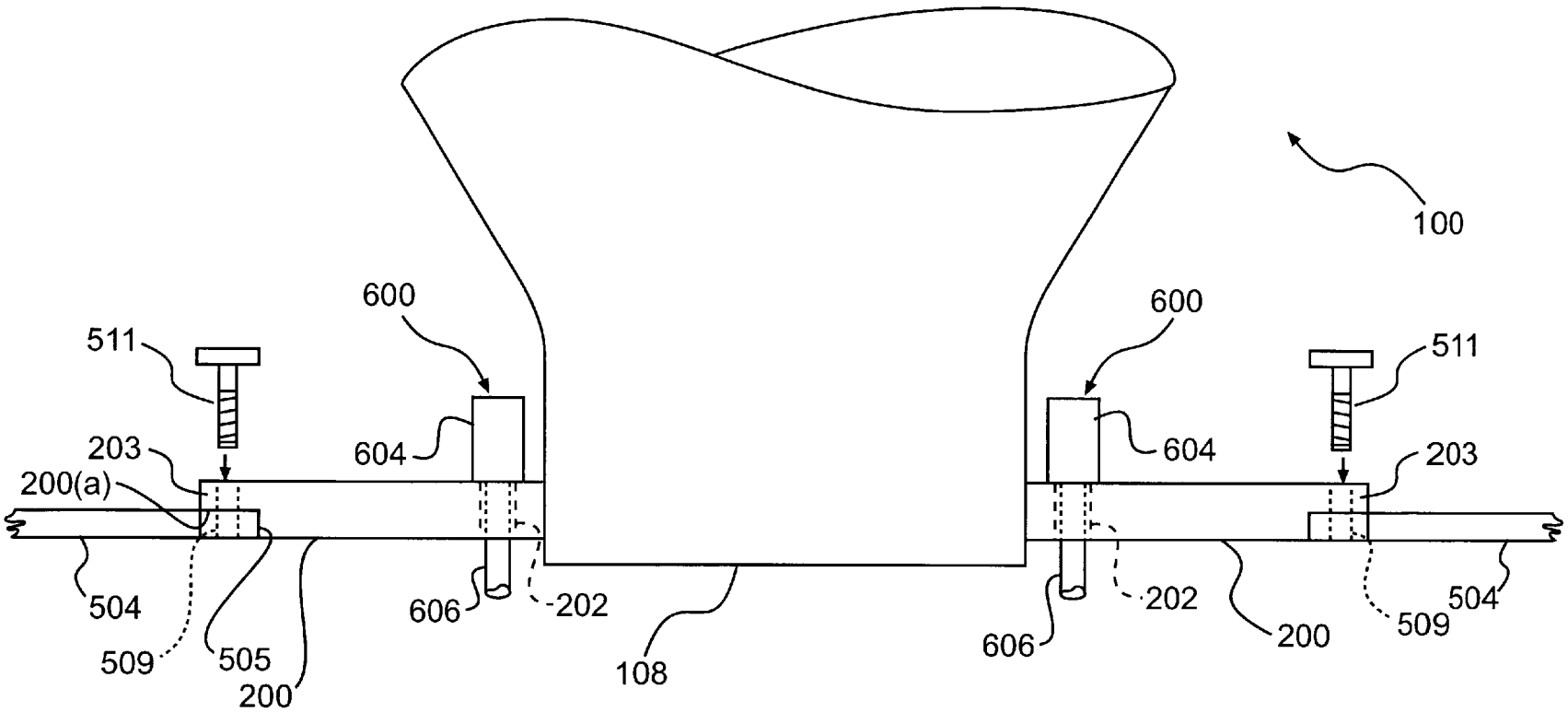
FIG. 8 is an enlarged elevation view showing a top casing of the present invention mounted to a flange of the present invention.

Referring to FIG. 3, the flange 200 is disposed around, and substantially flush with, the open end 108 of the drum 100. The periphery of the flange 200 includes a step portion 200(*a*). The flange 200 may be constructed of a high-strength thermally-stable material such as low-alloy carbon steel, for example. Other suitable materials may also be substituted, as is well known in the art. Holes 202, for receiving bolts 606 (shown in FIG. 8), are spaced circularly and substantially evenly around the flange 200. A second set of holes 203 are spaced circularly and evenly around the step portion 200(*a*) of the flange 200. The holes 203 receive bolts 511 for securing the top casing 504 of the chassis 500 to the flange 200, as shown in FIG. 8. There is an opening 204 in the center of the flange 200 to permit coke and quench water to exit through the open end 108 of the drum 100 during a decoking process. Preferably, the opening 204 is generally circular, which is an advantageous configuration for a drum of circular cross-section. Alternatively, the opening can be other shapes. In the illustrated embodiment, the drum 100 extends slightly beyond the flange 200 to form a lip 206 which helps to achieve a tight seal between the open end 108 of the drum 100 and the removable cover 300, as will be discussed in more detail below.

Figure 4:
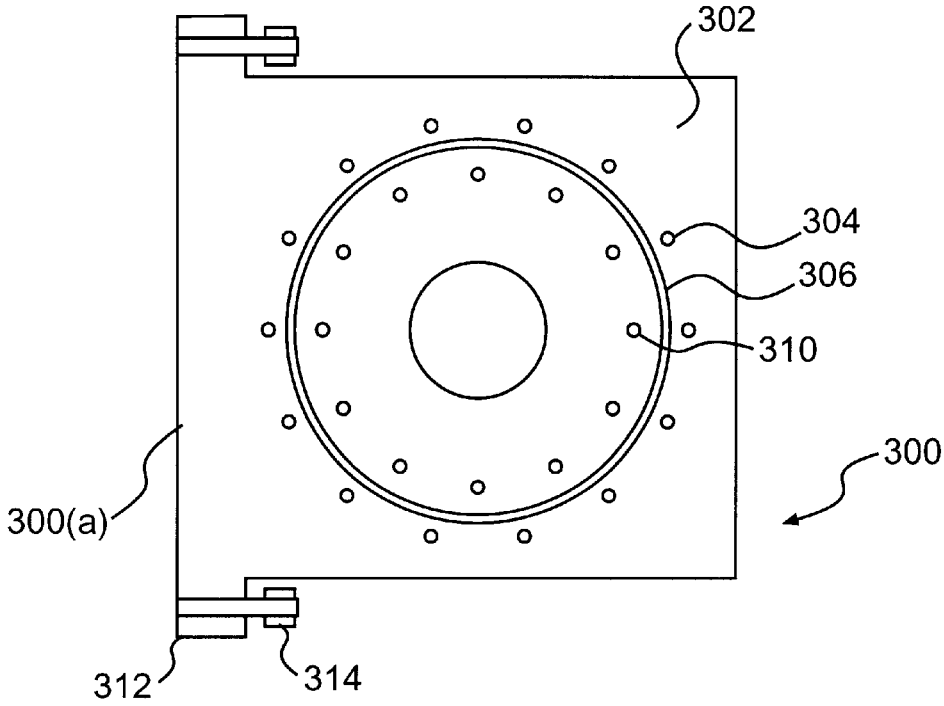
FIG. 4 shows a top plan view of a removable cover of the present invention.
Figure 5:
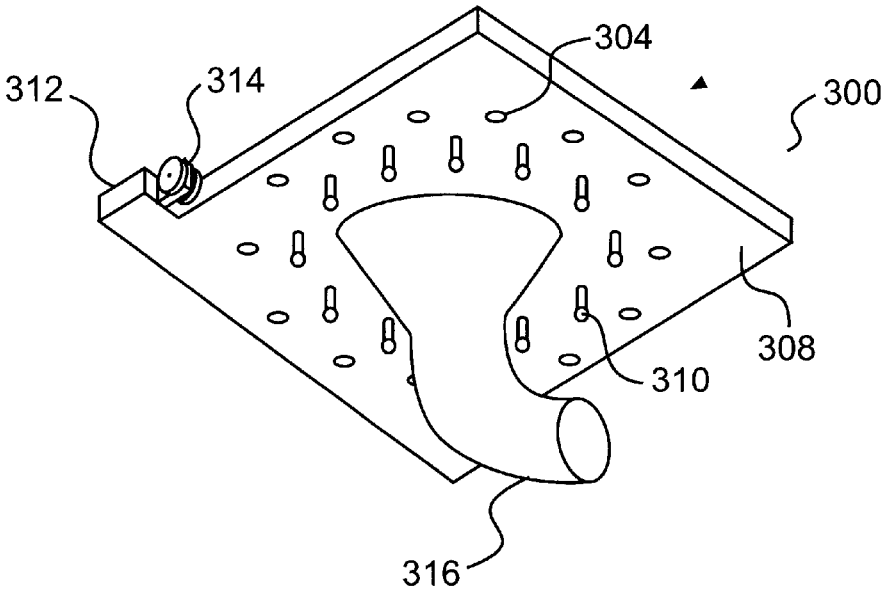
FIG. 5 shows a perspective view of a bottom of the removable cover of the present invention.

Turning to FIGS. 4 and 5, the removable cover 300 is shown to be generally rectangular in shape, as viewed from above. The cover 300 has an elongated end 300(*a*) extending from the left side thereof and an upper surface 302 adapted to mate and tightly seal with the flange 200. To this end, a groove 306 is provided on the upper surface 302 of the cover 300 and is configured to accept a gasket (not shown). In the illustrated embodiment, the groove 306 is circular. However, it is to be understood that the shape of the groove 306 may be varied. The cover 300 also includes through-holes 304, shoulder bolts 310, and a pair of wing-like projections 312. In the illustrated embodiment, the through-holes 304 are spaced circularly and substantially evenly around the periphery of the groove 306, but the location and configuration of the through-holes 304 may be varied as will be discussed below.

The wing-like projections 312 are located at the elongated end 300(*a*) of the cover 300. In the illustrated embodiment, the projections 312 are integrally formed with the cover 300 and have the same thickness as the cover 300. Pivotable connectors 314 extend from the projections 312. Each pivotable connector 314 is located and configured to engage the distal end of a piston rod 802 (shown in FIG. 9). Thus, the removable cover 300 remains engaged to the actuator associated with the rod 802 at all times.

The shoulder bolts 310, best seen in FIG. 5, extend from the underside 308 of the removable cover 300. As discussed below, the shoulder bolts 310 allow for slidable mounting of the lock plate 400 with respect to the cover 300. The number and configuration of the shoulder bolts 310, it is to be understood, may vary, depending on, inter alia, various design choices of the cover 300, the lock plate 400, and the shoulder bolts 310 themselves. The cover 300 also includes a lateral conduit 316, attached to its underside 308, for feeding hydrocarbon, steam, and water into the drum 100 through its open end 108, as well as for draining water and other byproducts from the drum 100.

Figure 6:
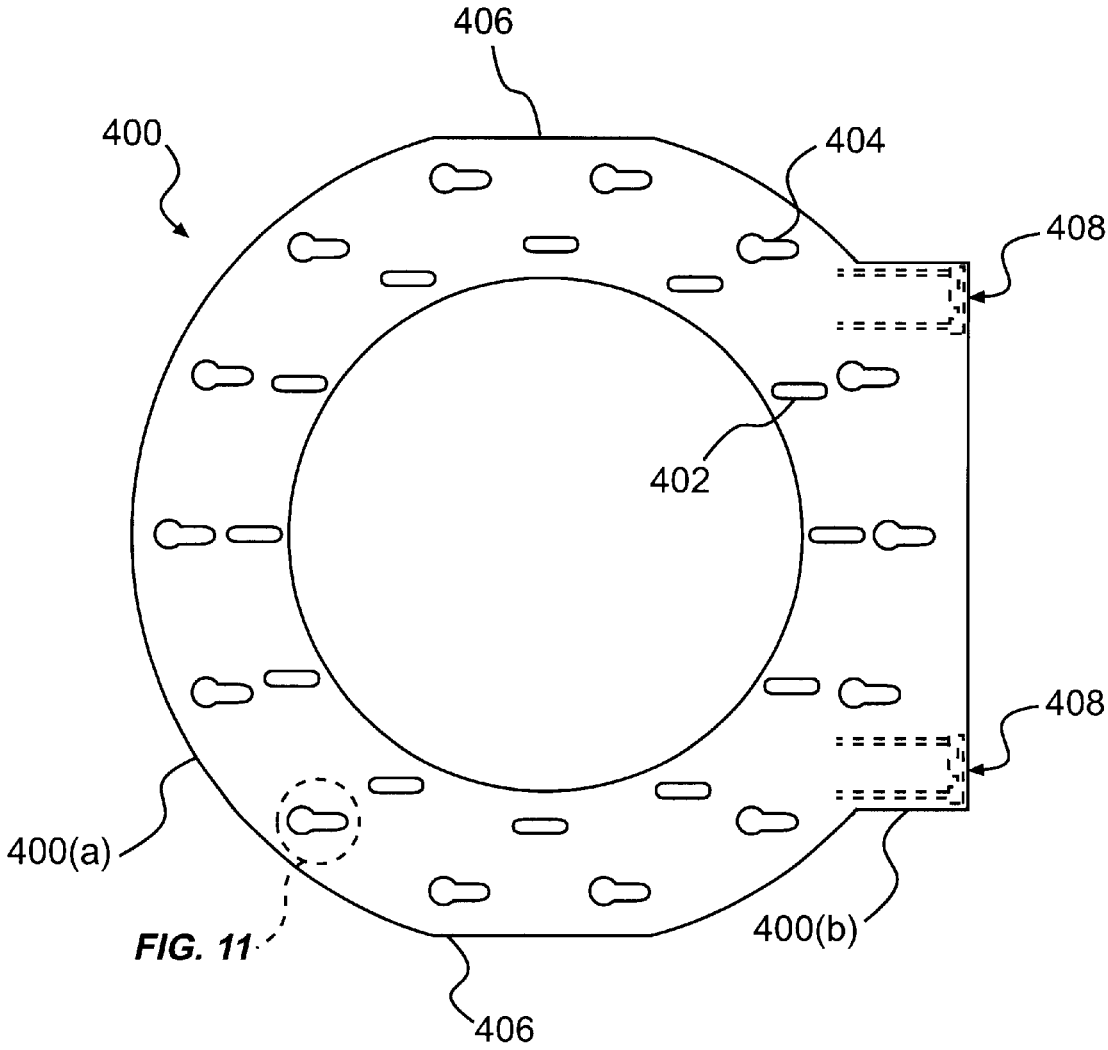
FIG. 6 shows a top plan view of a lock plate of the present invention.

FIG. 6 illustrates the lock plate 400 of the present invention. The lock plate 400 is a truncated annulus having an annular portion 400(*a*), a squared end 400(*b*), and straight sections 406. This annular shape is an advantageous configuration for a drum of circular cross-section. However, the lock plate can be other shapes. The lock plate 400 is dimensioned to travel within the chassis 500 in a manner discussed in detail below. The straight sections 406 allow for an annular portion 400(*a*) of greater diameter while still permitting the lock plate 400 to travel within the chassis 500.

Slotted holes 402 and holes 404 are spaced circularly and substantially evenly around the lock plate 400. The slotted holes 402 are dimensioned to accept, and to cooperate with, the shoulder bolts 310 extending from the removable cover 300. Thus, the number and location of the slotted holes 402 corresponds to the number and location of the shoulder bolts 310. The holes 404 are positioned for alignment with the holes 304 of the removable cover 300 and the holes 202 of the flange 200 when the drum 100 is headed by the cover 300.

Figure 13:
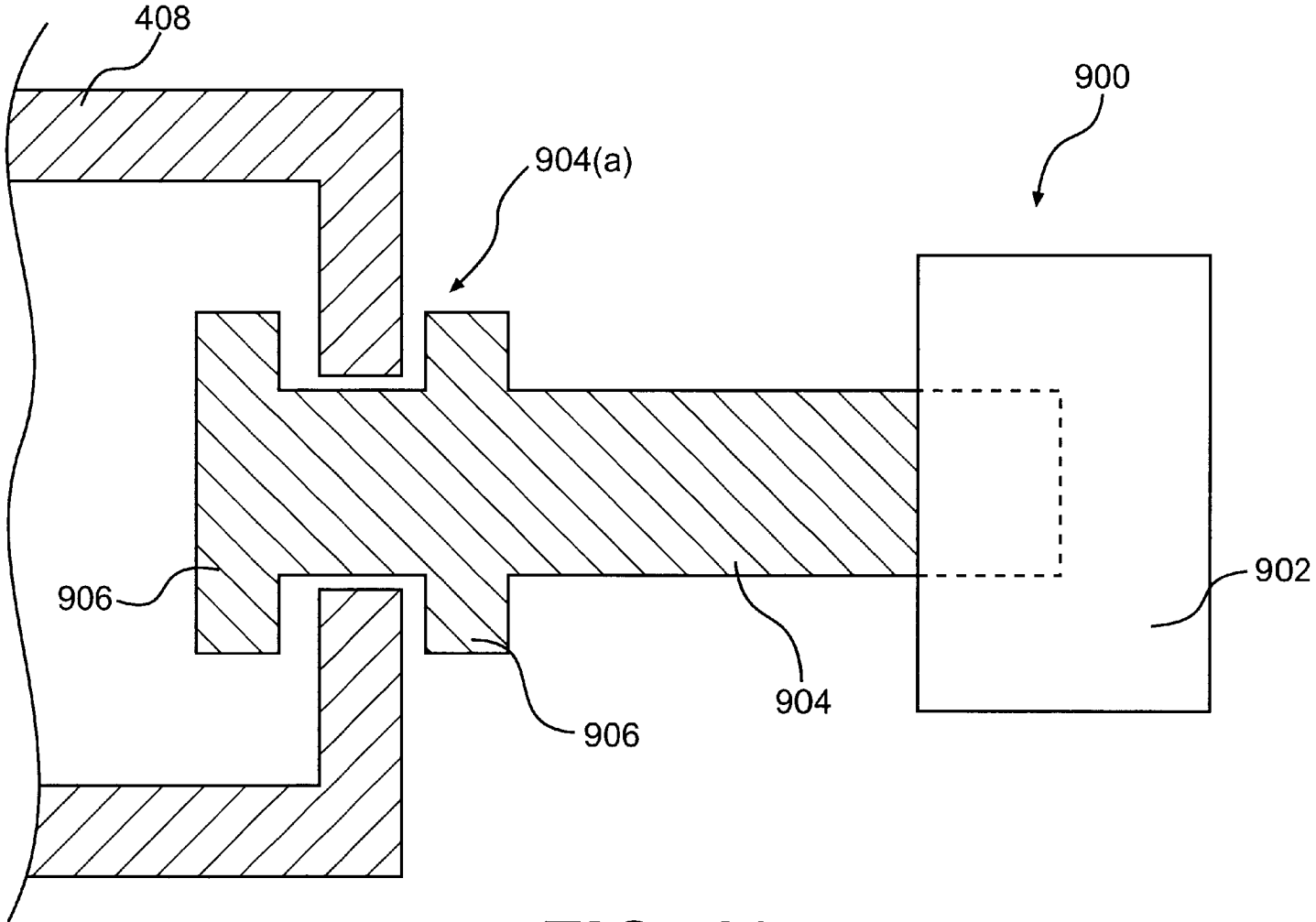
FIG. 13 shows a cross-sectional view along lines I—I of FIG. 12 with a piston rod of a short-stroke horizontal piston actuator engaged in the slot.

The lock plate 400 also includes slots 408 on its squared end 400(*b*). Each slot 408 is located and configured to engage and removably retain a complimentary configured distal end of a piston rod 904, as shown in FIG. 13.

The lock plate 400 is slidably mounted to the underside of the removable cover 300 by the shoulder bolts 310. The shoulder bolts 310 extend through, and cooperate with, the slotted holes 402 so as to allow limited slidable movement of the lock plate 400 relative to the cover 300.

Figure 7:
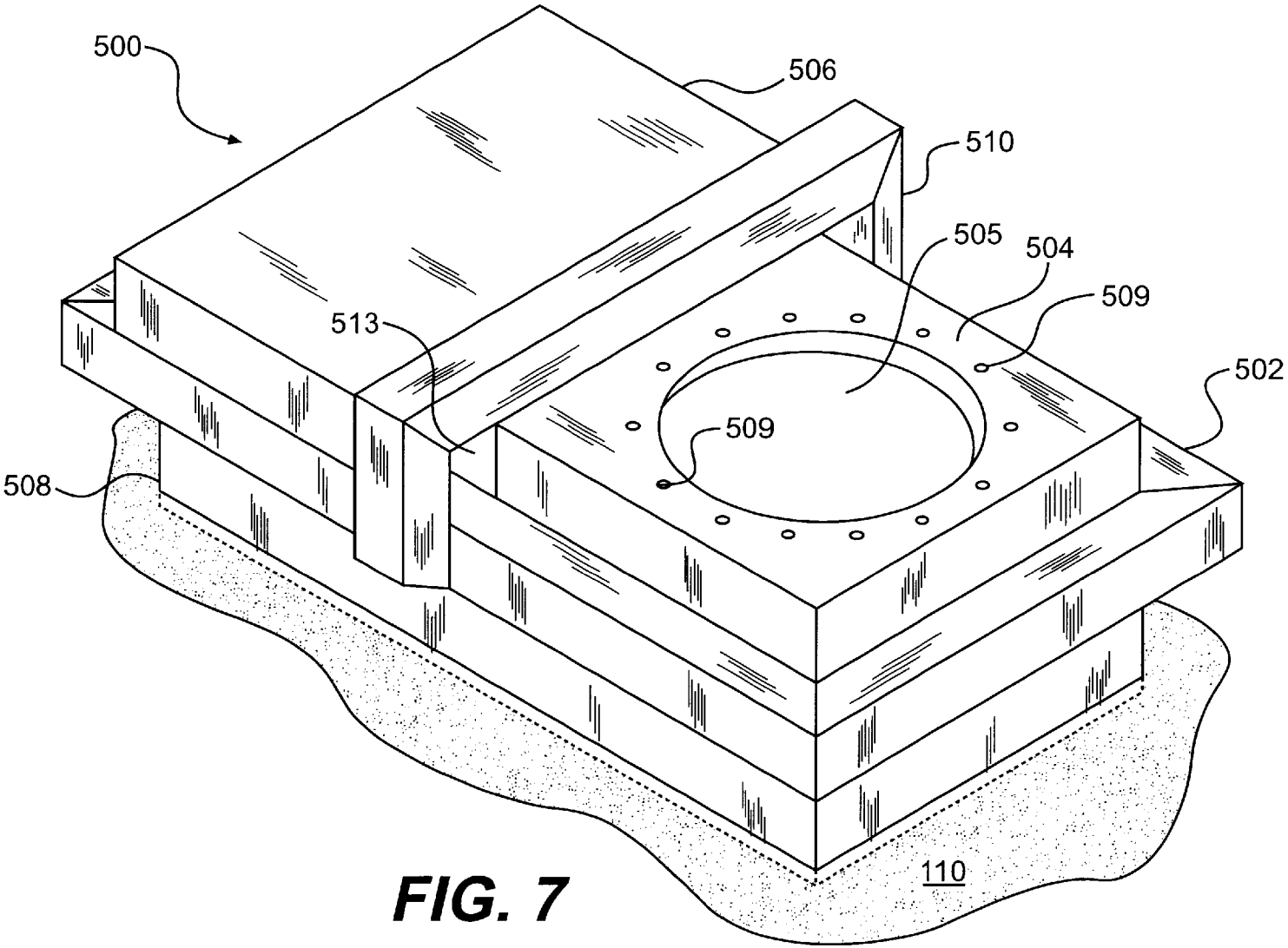
FIG. 7 shows a perspective view of the chassis of the present invention.

FIG. 7 shows the chassis 500 that encloses the open end 108 of the drum 100, the flange 200, the removable cover 300, and the lock plate 400. The chassis 500 includes a chassis body 502, a top casing 504, a hood 506, a skirt 508, and a box beam 510.

In the preferred embodiment shown, the chassis 500 is generally rectangular in cross-section. The chassis 500 is dimensioned to enclose an area wider than the removable cover 300. The skirt 506 extends through an opening in the floor 110. The top casing 504 is disposed on an upper side of the chassis 500 and includes a drum opening 505 for receiving the lower end of the drum 100. Holes 509 are spaced around the opening and aligned with the holes 203 in the flange 200. Bolts 511 extend through the holes 509 and 203 to secure the chassis 500 to the flange 200.

Figure 9:
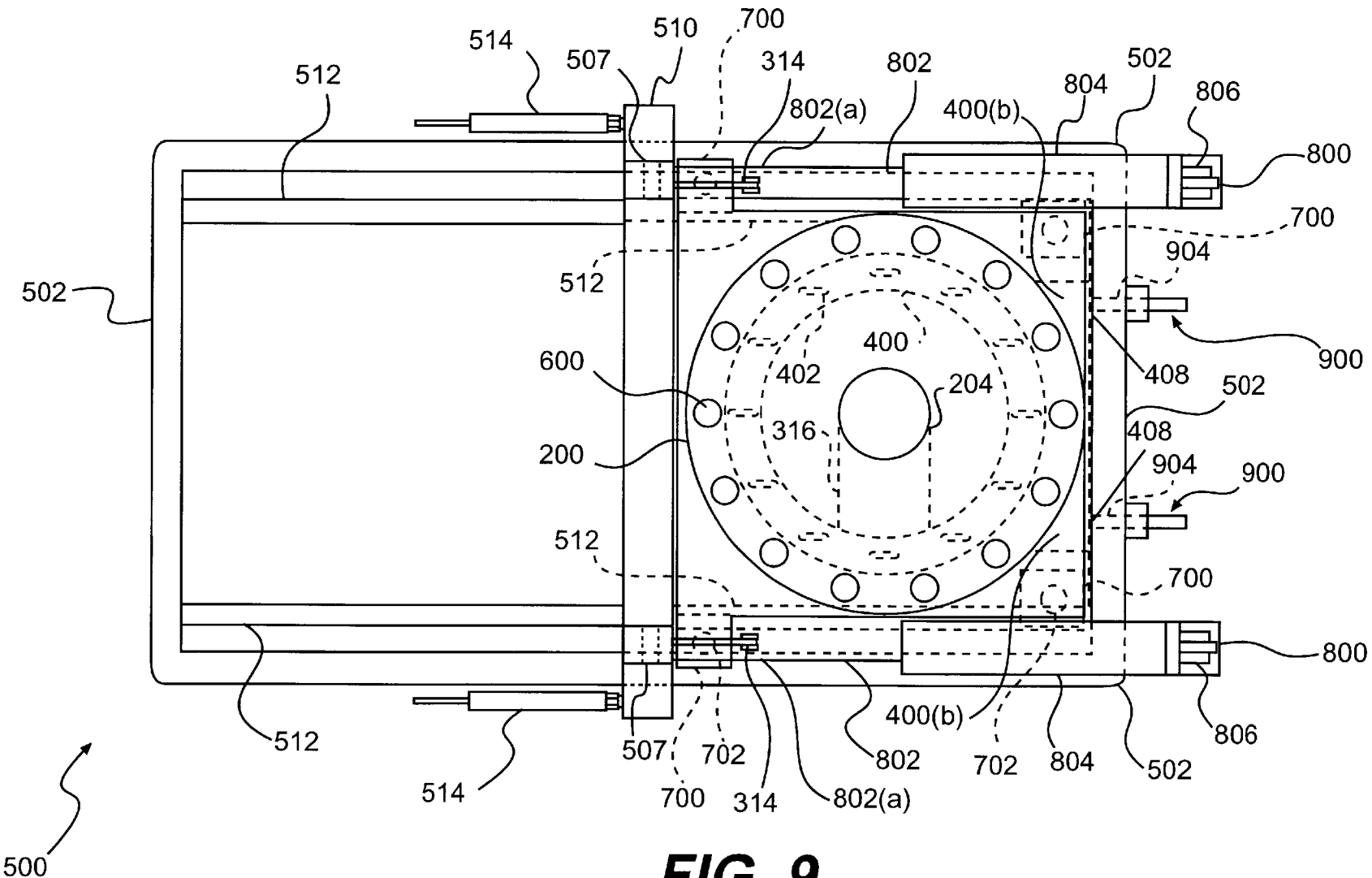
FIG. 9 shows a top plan view of the unheading and containment system of the present invention.

The hood 506 is hinged to the chassis 500 by hinges 507 (shown in FIG. 9). An actuator assembly 514 (also shown in FIG. 9) pivots the hood 506 about the hinges 507. In the closed position shown in FIG. 7, the hood 506 is seated against the chassis body 502 and the box beam 510. The periphery of the hood 506 is fitted with a gasket (not shown) to ensure that the hood/chassis and hood/box beam interfaces are sealed to prevent drum discharge from leaking during the unheading and decoking process. A second gasket (not shown), which is circular in shape, is provided between the cover 300 and the flange 200 and normally rests in the groove 306 of the cover 300. After the unheading and decoking procedures are completed, the hood 306 may be pivoted upwardly about the hinges 507 to permit cleaning of the cover 300. While the hood is raised, the second gasket, which preferably is a double metal jacketed gasket, can be replaced. The hood is wider than the top casing to provide openings 513 for accommodating piston rods 802 (shown in FIG. 9).

The skirt 508 is attached to a lower side of the chassis body 502. The skirt 508 is preferably formed of a relatively high-strength material, such as a low alloy carbon steel, for example. Other suitable materials, well known in the art, can be substituted. The skirt 508 extends downwardly from the chassis body 502 through the floor 110. Thus, the skirt 508, the box beam 510, the hood 506, the top casing 504, and the chassis body 502 cooperate to substantially enclose the space beneath the open end 108 of the drum 100 so as to confine any discharge from the drum 100 during the unheading and decoking process.

As illustrated in FIG. 8, the step portion 200(*a*) of the flange 200 is dimensioned to overlap a portion of the top casing 504 adjacent to the drum opening 505. The holes 203 of the step portion 200(*a*) are aligned with the holes 509 of the top casing 504. Bolts 511 extend through the holes 203 and 509 to secure the chassis 500 to the flange 200. In this manner, the flange 200 supports the weight of the chassis 500.

FIG. 9 shows a plan view of the present invention with the drum 100, the hood 506, and the top casing 504 removed for purposes of illustration. Rails 512 extend laterally within the chassis 500 along its length and are configured to allow the removable cover 300 to travel thereon. Each of the rails 512 can be a single element or, alternatively, a series of aligned shorter rails. Also shown in FIG. 9 is an actuator assembly 514 that is used to pivot the hood 506 about hinges 507. The actuator assembly 514 is connected at one end to the box beam 510 and at the other end to the hood 506.

A number of actuators are mounted to the chassis 500 for moving the cover 300 and the lock plate 400 within the chassis from a headed position, where the removable cover 300 is mated to the flange 200, to an unheaded position, where the cover 300 is positioned adjacent to the drum 100.

The term "actuator" broadly includes any mechanical, electrical or hydraulic device suitable for movably positioning the cover 300 and/or the lock plate 400.

More specifically, as best seen in FIG. 9, the chassis 500 includes four vertically-oriented piston actuators 700 for lowering and raising the cover 300 during unheading and heading. Each piston actuator 700 is mounted to the underside of the chassis body 502 above the skirt 508. The piston actuators 700 are capable of providing sufficient lifting force to maintain the removable cover 300 in the mated position during the unheading and heading process.

Each piston actuator 700 includes a piston rod 702 configured to engage the underside 308 of the removable cover 300. In the illustrated embodiment, the piston actuators 700 are arranged to engage the corners of the cover 300 when the cover 300 is aligned with the drum 100. The piston actuators 700 lower the cover 300 onto the rails 512 of the chassis 500, preferably at a level plane such that the upper surface 302 of the cover 300 is parallel to the flange 200 throughout the unheading process. As will be appreciated, the location and configuration of the piston actuators 700 can be varied without changing their function.

Still referring to FIG. 9, the chassis 500 also includes dual horizontally-oriented long-stroke piston actuators 800 adapted for controllably moving the cover 300 laterally within the chassis 500 along the rails 512. Each long-stroke piston actuator 800 includes a piston rod 802 slidably disposed in a cylinder 804. The distal end 802(*a*) of each rod 802 is configured to pivotably engage the pivotal connectors 314 of the cover 300. This engagement may be achieved through any number of means typical in the art, including, for example, a hinge arrangement. This pivotable engagement allows the long-stroke piston actuators 800 to remain engaged with the removable cover 300 throughout the heading and unheading cycle. The long-stroke piston actuators 800 are attached to the chassis 500 by hinges 806.

After the cover 300 is lowered onto the rails 512 by the vertically-oriented piston actuators 700, the horizontally-oriented piston actuators 800 are actuated to extend the rods 802 and move the cover 300 from an aligned position under the drum 100 to an offset position relative to the drum 300. When extended, the rods 802 pass through the openings 513 in the chassis 500. The openings 513 receive the rods 802 but can otherwise be sealed to prevent discharge from the drum 100 from escaping during the unheading and decoking process.

Multiple bolt tensioning units 600, shown in FIG. 8, are mounted on the top side of the flange 200. The tensioning units 600 may be mounted to the flange 200 by any conventional means, such as, for example, mounting brackets and bolts or the like. In the illustrated embodiment, the tensioning units 600 are circularly and substantially evenly spaced around the periphery of the flange 200. However, the number and location of the tensioning units 600 may vary, depending on, inter alia, the construction of the flange 200 and the pressure rating of the drum 100. The locations of the tensioning units 600 correspond to the locations of the holes 202 of the flange 200.

Each tensioning unit 600 is constructed and operated similarly. As best seen in FIG. 8, each tensioning unit 600 comprises a cylinder 604 and a bolt 606. The tensioning units 600 are usually operated by a suitable hydraulic pressure source. U.S. Pat. Nos. 6,223,925 and 6,085,929 to Malsbury, et al., each of which is incorporated by reference herein, disclose bolt tensioning units that can be utilized for the purposes described herein.

Figure 10:
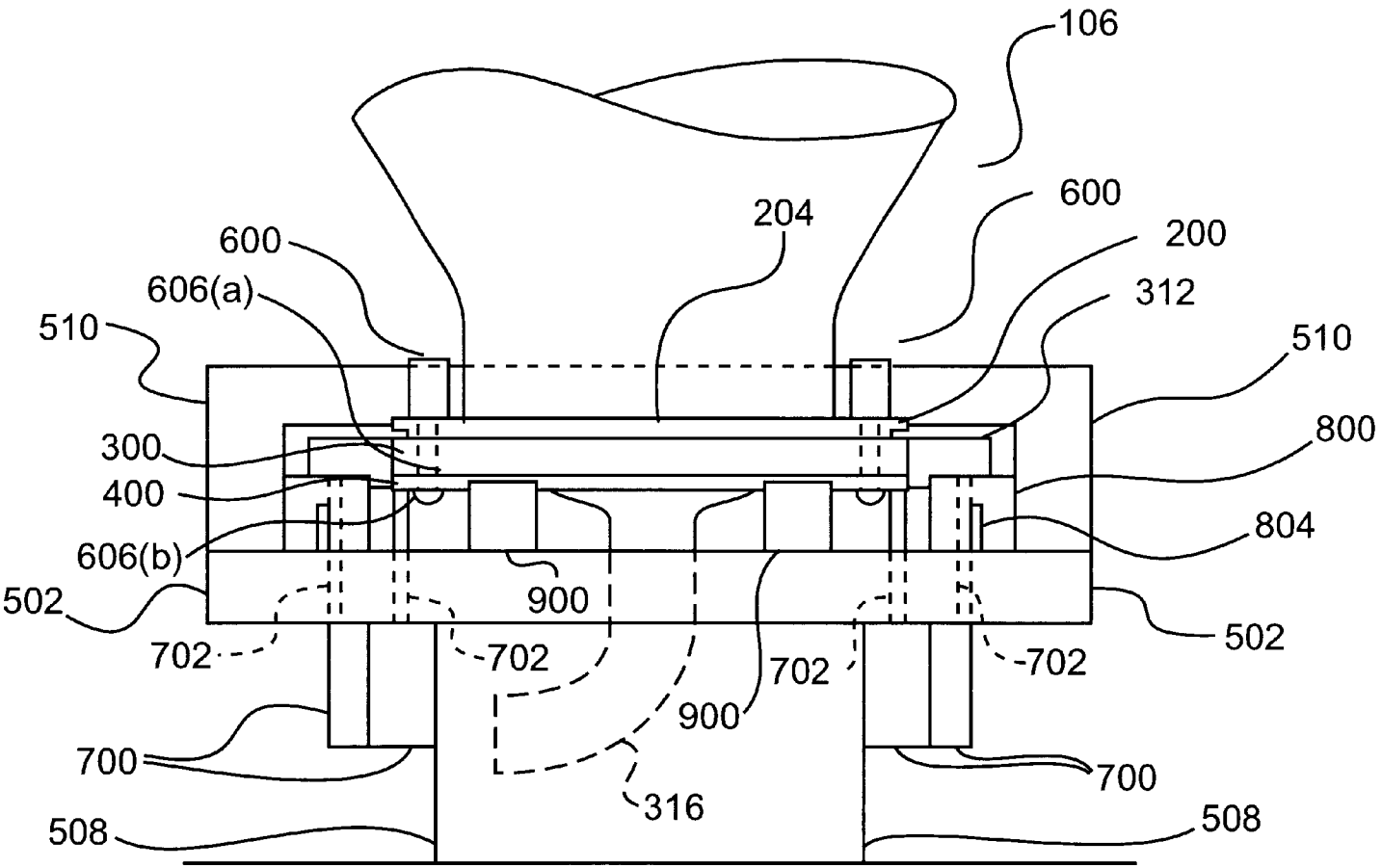
FIG. 10 shows a side elevation view of the unheading and containment system of the present invention.

Each bolt 606 is slidably disposed in the cylinder 604 of a respective one of the tensioning units 600. As best shown in FIG. 10, each bolt 606 includes a shank 606(*a*) and a head 606(*b*). The head 606(*a*), which either can be secured to the bolt or integrally formed therewith, is larger in diameter than the shank 606(*a*) in cross section, but is smaller in diameter than the holes 202 of the flange 200, the holes 304 in the removable cover 300, and, as is discussed in detail below, a portion of the holes 404 in the lock plate 400. Preferably, the bolt head 606(*a*) is a hex nut or the like, which is threaded onto the bolt shank 606(*b*). This provides a convenient means for making fine adjustments to the location of the head 606(*a*) relative to the other elements of the mechanism.

Figure 11:
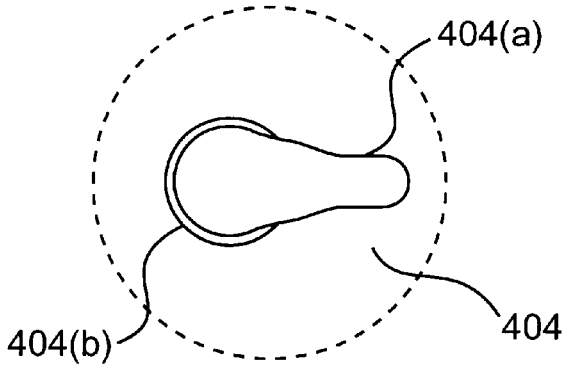
FIG. 11 shows an enlarged view of one of the keyhole-shaped holes in the lock plate.

As best seen in FIG. 11, each of the holes 404 in the lock plate 400 includes at least two different-sized regions that are alternately alignable with the bolts 606—a narrowed portion 404(*a*), through which the heads 606(*b*) of the bolts 606 cannot fit longitudinally, and an enlarged portion 404 (*b*), through which the heads 606(*b*) of the bolts 606 can fit longitudinally. The holes 404 can be shaped in any of several ways to achieve this result. In the illustrated embodiment, each hole 404 is shaped like a key hole. However, one of ordinary skill in the art will recognize that other configurations are also possible. It is noted that the portion of the lock plate 400 surrounding the narrowed portion 404(*a*) of each hole 44 provides a bearing surface for a respective bolt head 606(*b*).

As discussed above, the lock plate 400 is slidably mounted to the underside 308 of the removable cover 300 by the shoulder bolts 310. The shoulder bolts 310 extend through the slots 402 in the lock plate 400, which slots are configured to allow limited selective lateral movement of the lock plate 400 relative to the cover 300. Thus, the lock plate 400 can be moved from a "locked" position, in which the narrowed portions 404(*a*) of the holes 404 are aligned with the bolt heads 606(*b*), to an "unlocked" position, in which the enlarged portions 404(*b*) of the holes 404 are aligned with the bolt heads 606(*b*).

As shown in FIG. 10, when the drum 100 is headed, the cover 300 is sandwiched between the flange 200 and the lock plate 400. In this condition, the lock plate 400 is in the locked position and the bolts 606 extend through the holes 202 in the flange 200, the holes 304 in the cover 300, and the narrowed portions 404(*a*) of the holes 404 in the lock plate 400.

Figure 12:
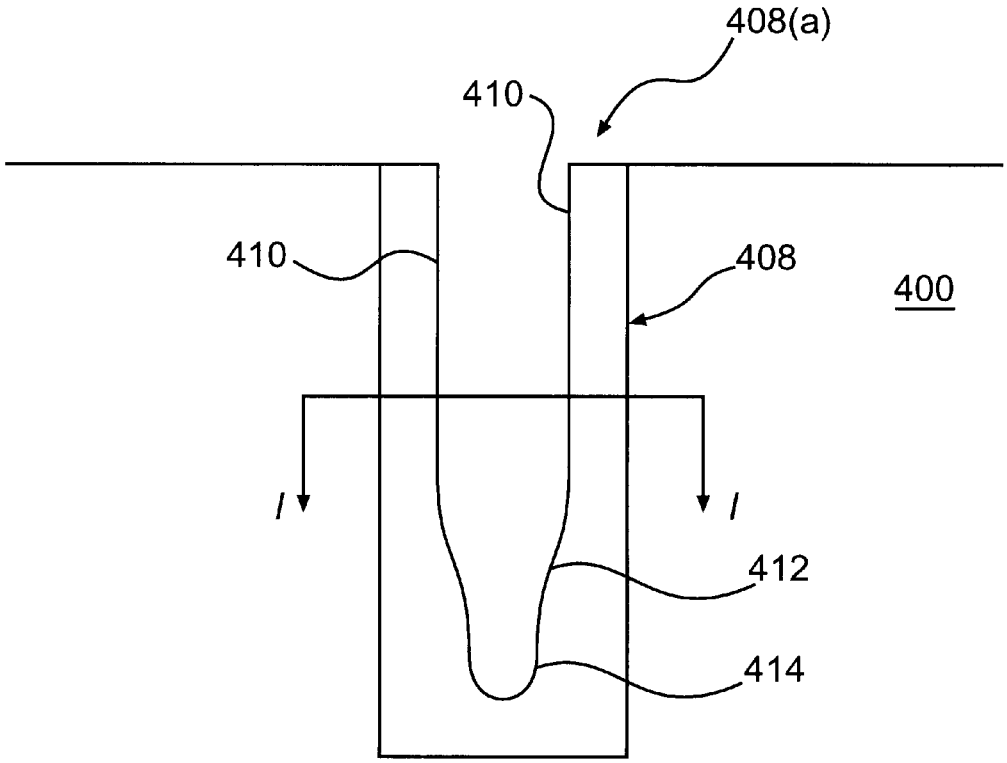
FIG. 12 shows an cross-sectional view of a slot in the lock plate.

The slots 408 of the lock plate 400, shown in cross section in FIGS. 12 and 13, are configured to automatically engage the complimentary configured distal ends 904(*a*) of the piston rods 904 of the horizontally-oriented short-stroke piston actuators 900 when the removable cover 300 is raised in a manner discussed in detail below. In this illustrated embodiment, each slot 408 includes parallel sidewalls 410 extending from a slot opening 408(*a*) and a narrowing portion 412 where the sidewalls 410 taper inwardly toward a capture portion 414 at the distal end of the slot 408.

The horizontally-oriented short-stroke piston actuators 900 are positioned on the chassis 500 to move the lock plate 400 from the locked position to the unlocked position and vice versa. Each short-stroke piston actuator 900 comprises a cylinder 902 and a rod 904. As FIG. 13 illustrates, the distal end 904(*a*) of each rod 904 is provided with extensions 906 for engagement with a respective slot 408 of the lock plate 400. In the illustrated embodiment, the distal end 904(*a*) is greater in diameter than the remainder of the rod 904 and the extensions 906 are formed by a circumferential groove in the distal end 904(*a*). However, one of ordinary skill in the art will recognize that other configurations are possible, such as laterally-extending wings. The short-stroke piston actuators 900, when actuated, selectively retract or extend the rods 904, thus moving the lock plate 400 with respect to the cover 300, as described below.

As the removable cover 300 is raised by the vertically-oriented piston actuators 700, the distal ends 904(*a*) of the rods 904 slide down the slots 408 toward the capture portions 414. As the removable cover 300 continues to rise, each rod 904 slides to a final position seated in the capture portion 414. Thus, the extensions 906, in cooperation with the slots 408, allow the rods 904 to engage with, and disengage from, the lock plate 400 when the cover 300 is in the aligned position and is raised or lowered by the vertically-oriented piston actuators 700.

The lock plate 400 is moved by the horizontally-oriented piston actuators 900, preferably by at least two bi-directional piston actuators.

In a particularly advantageous application, the present invention may be used with what is commonly referred to as an "unheading deck floor." An unheading deck floor typically has an opening that leads to a coke pit below. In a conventional unheading deck floor installation two chutes are required—a "first chute" extending from the drum opening to the floor opening, and a "second chute" extending from the floor opening to the coke pit.

When employed with an unheading deck floor, the chassis 500 and the skirt 508, which enclose the area from past the open end 108 of the drum 100 through the floor 110, may be used to channel water and coke exiting the open end 108 of the drum 100 in place of the "first chute." Consequently, the need for any additional structures such as a coke chute extending from the drum to the floor is obviated.

Figure 14:
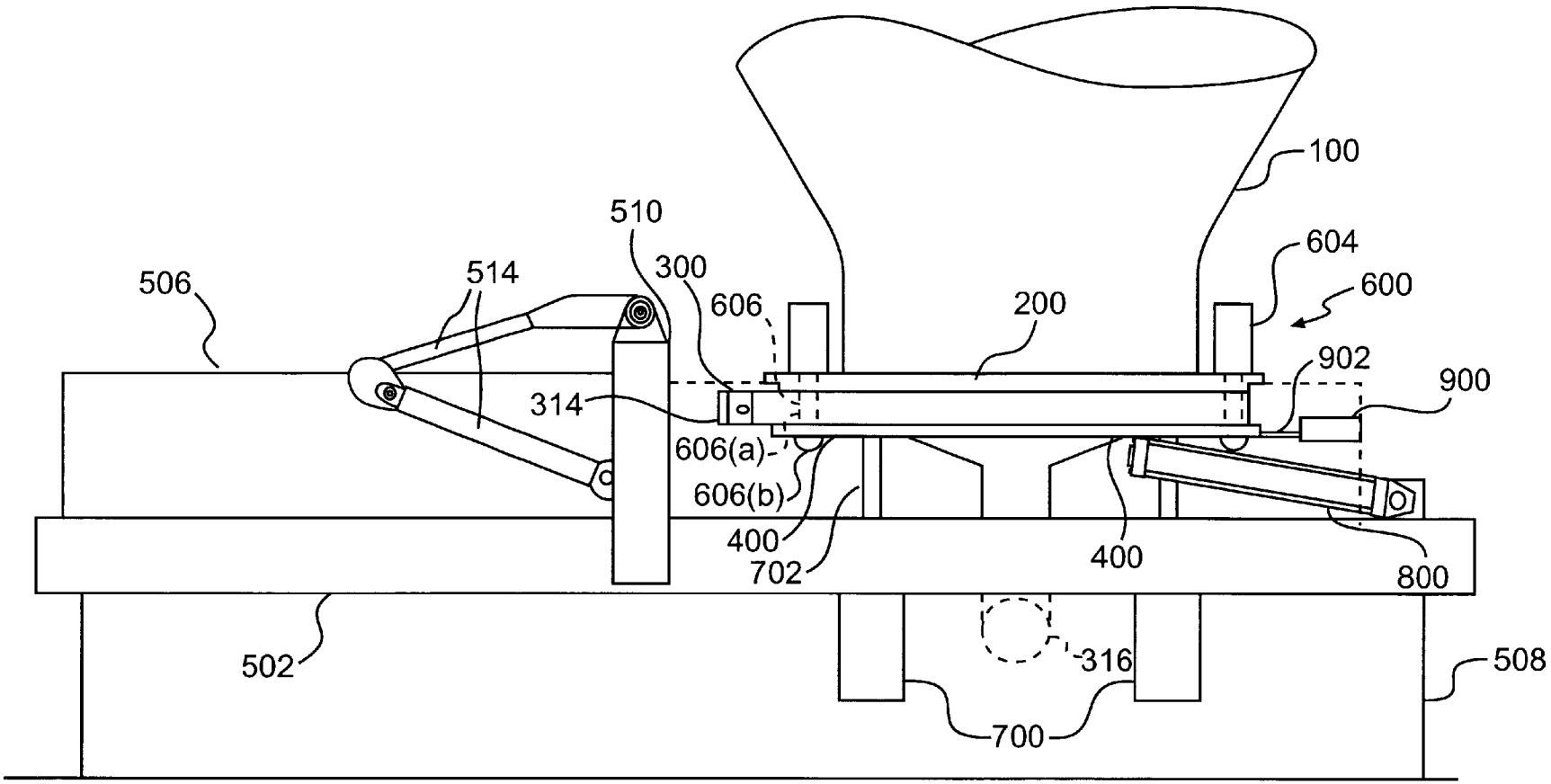
FIG. 14 is an elevation view showing the unheading and containment system of the present invention at the start of the unheading process.
Figure 15:
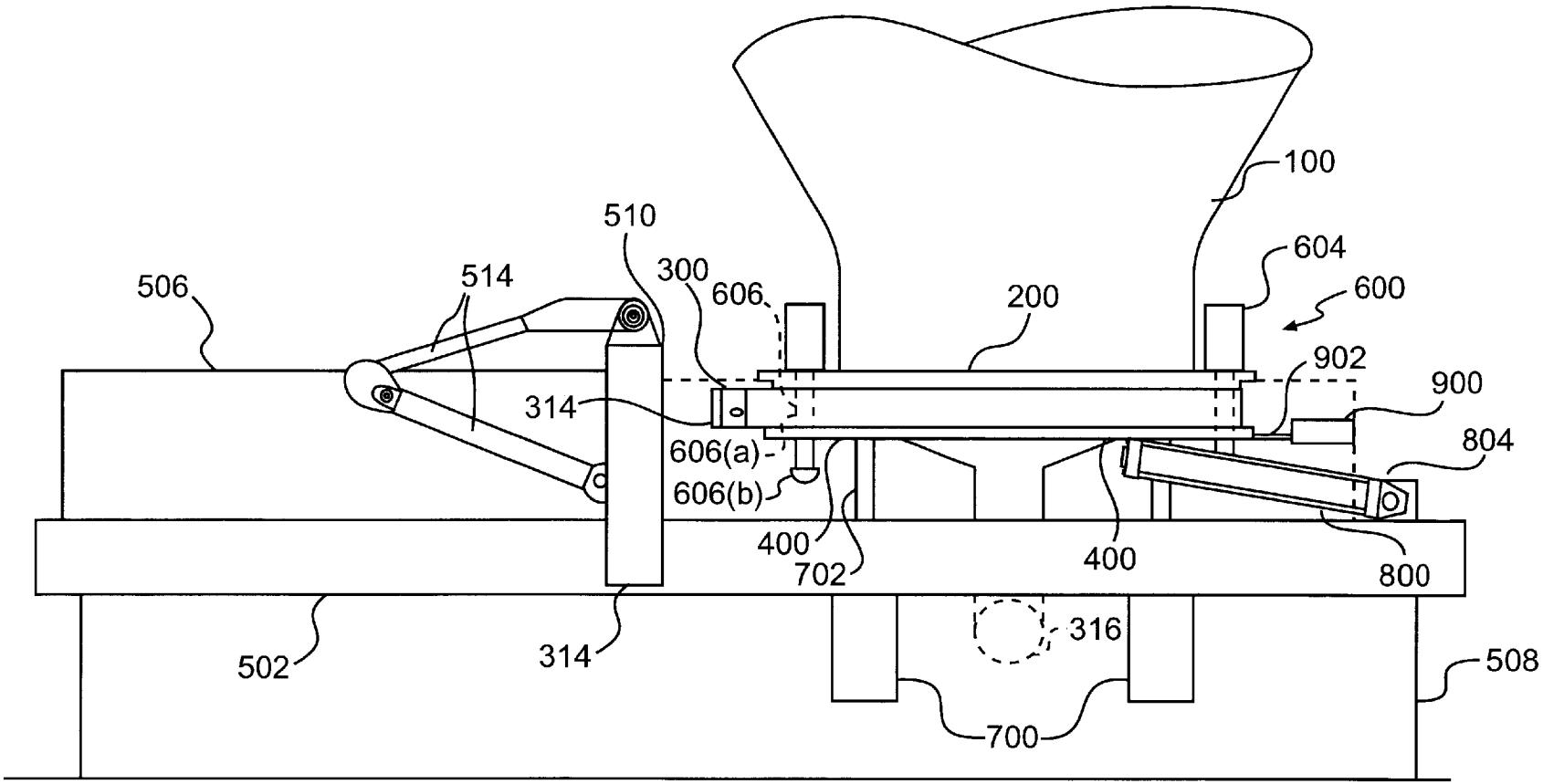
FIG. 15 is an elevation view showing the bolts extended by the bolt tensioners.

Referring now to FIGS. 14–19, which show the present invention with the top casing 504 removed for clarity, an unheading operation is described. As shown in FIG. 14, where the rod 802 is removed for clarity, the drum 100 is shown headed, with the cover 300 secured thereto. In this condition, the vertically-oriented piston actuators 700 apply a lifting force to the cover 300 and the lock plate 400 via the rods 702. In turn, the rods 702 transfer the full load of the removable cover 300, as well as a portion of the load bearing on the cover 300 by the drum's contents, to the chassis 500. Next, as shown in FIG. 15, the tensioning units 600 are actuated to extend the bolts 606. In this condition the flange-cover joint is detensioned allowing slidable movement of the lock plate 400.

Figure 16:
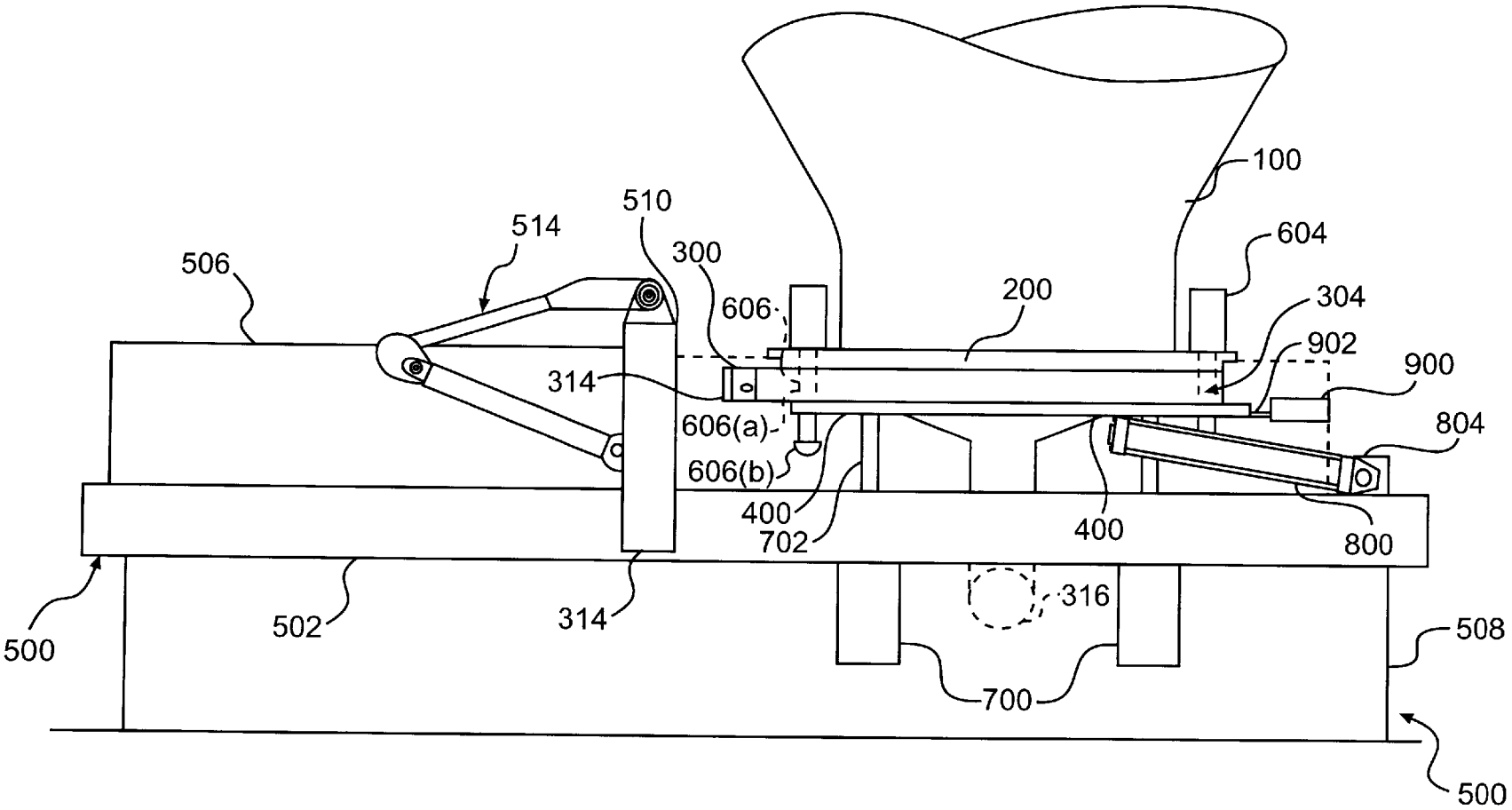
FIG. 16 is an elevation view showing the lock plate moved laterally to its unlocked position.
Figure 17:
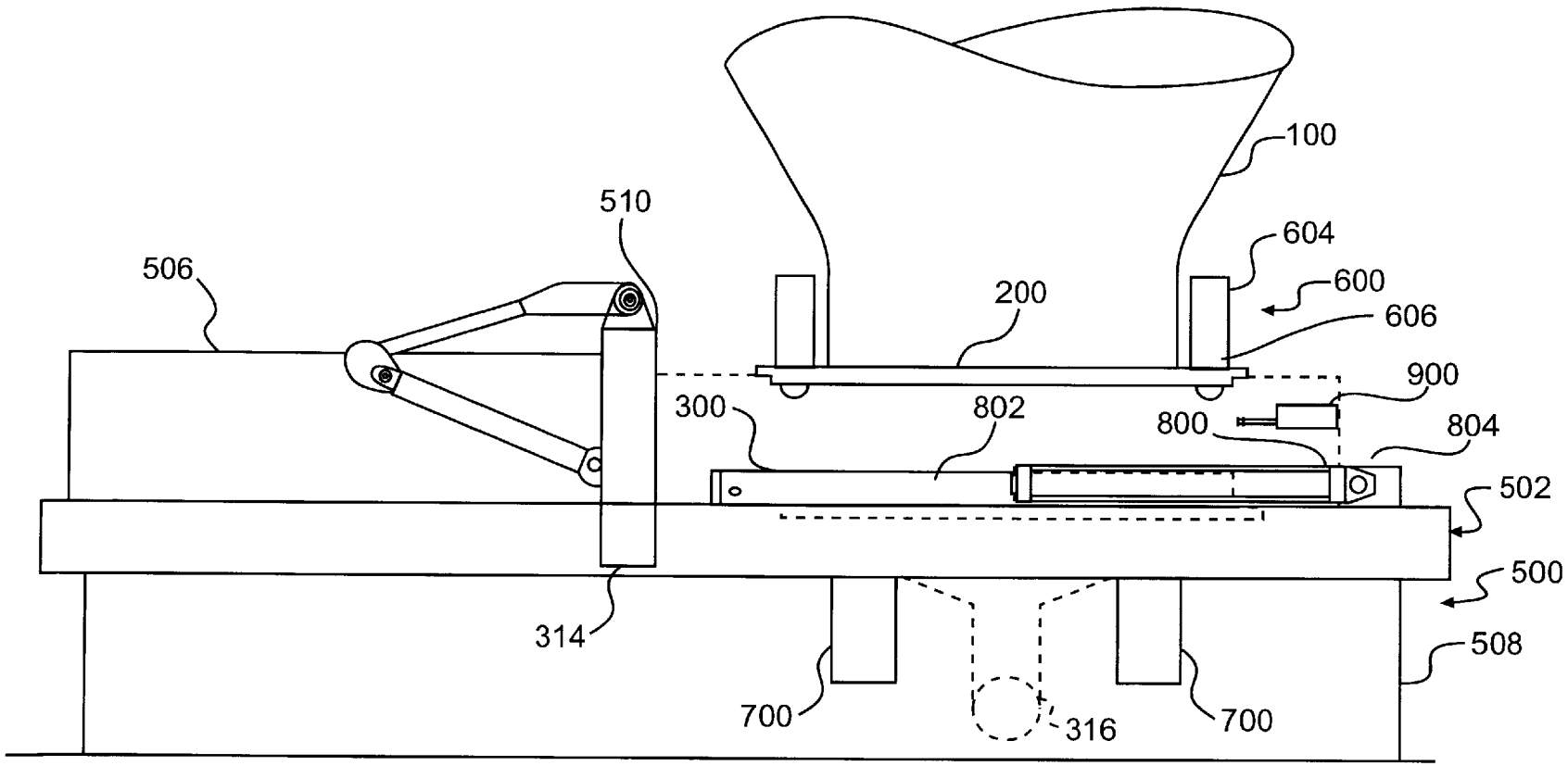
FIG. 17 is an elevation view showing the removable cover lowered from the coke drum onto rails.

Then, as FIG. 16 illustrates, the horizontally-oriented short-stroke piston actuators 900 are actuated to retract the rods 904 and horizontally move the lock plate 400 engaged thereto from a locked position to an unlocked position. In the unlocked position, the enlarged portions 404(*b*) of the holes 404 are aligned with the bolts 606, thereby allowing the lock plate 400, and thus the removable cover 300, to be separated from the flange 200. Thereafter, the vertically-oriented piston actuators 700 decrease the amount of lifting force applied to the removable cover, allowing the weight of the removable cover 300, the lock plate 400, and the contents of drum 100 to gradually and controllably overcome the lifting force. This net downward force retracts the rods 702, thus controllably lowering the removable cover 300 onto the rails 512 of the chassis 500, as shown in FIG. 17.

It is to be appreciated that several mechanical actions take place during the lowering of the removable cover 300. First, as the cover 300 is lowered, the distal ends 904(*a*) of the rods 904 slide up and out of the slots 408 of the lock plate 400. Second, the horizontally-oriented long-stroke piston actuators 800, pivoted upward by virtue of the position of the projections 312 and the pivotable connectors 314, pivot to a substantially horizontal position about the hinge 804. In this position the horizontally-oriented long-stroke piston actuators 800 are parallel to the rails 512.

Figure 18:
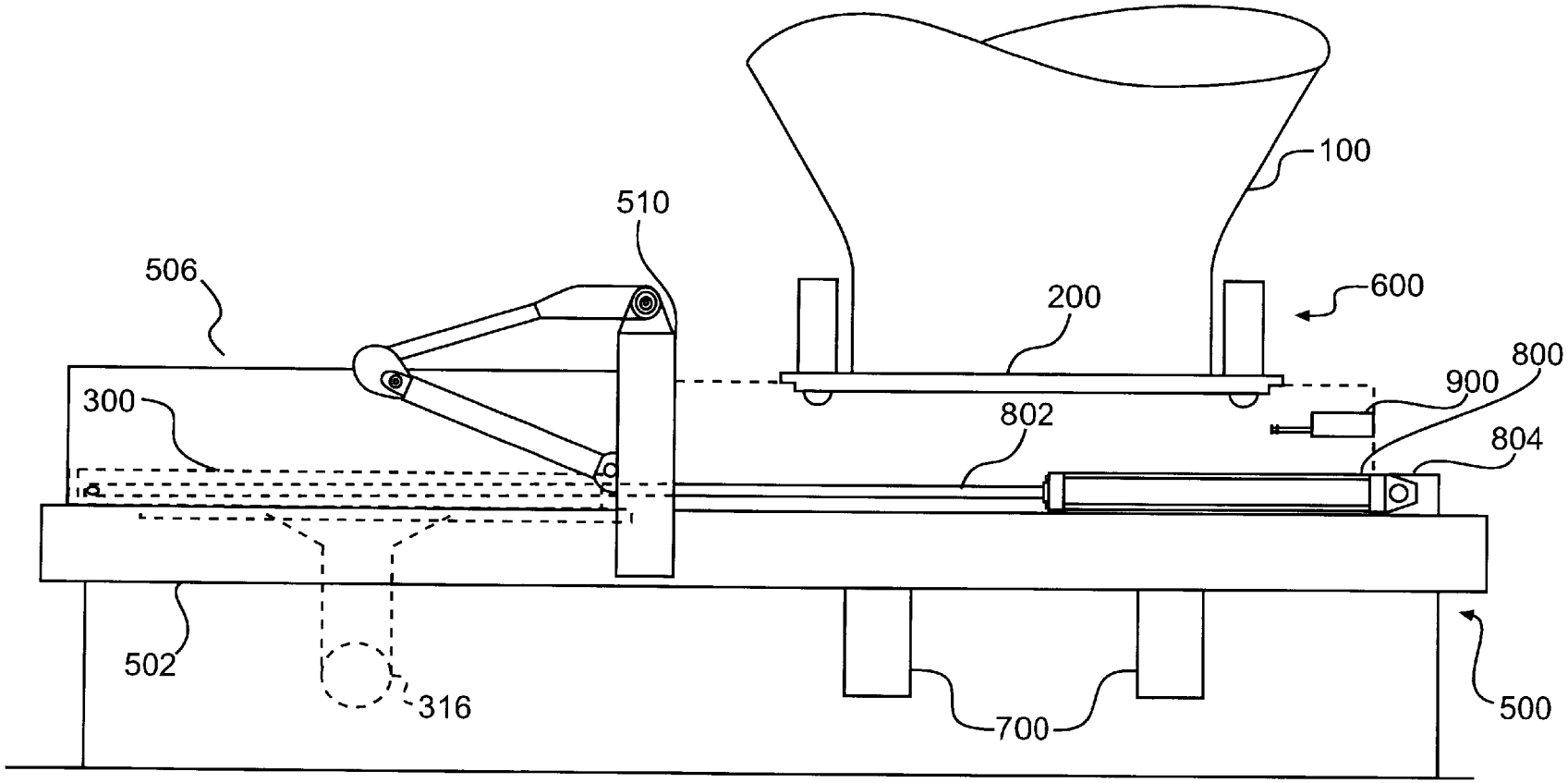
FIG. 18 is an elevation view showing the cover moved laterally away from the coke drum to a position under a hood.

As best seen in FIG. 18, when the removable cover has been lowered onto the rails 512 and the vertically-oriented piston actuators 700 retracted, the horizontally-oriented long-stroke piston actuators 800 are actuated to extend the rods 802 and move the cover 300 laterally aside to a position adjacent to the drum 100. As illustrated, the cover 300 is completely under the hood 506. The rods 802 extend through openings 513 while the cover 300 travels on the rails 51.2.

Figure 19:
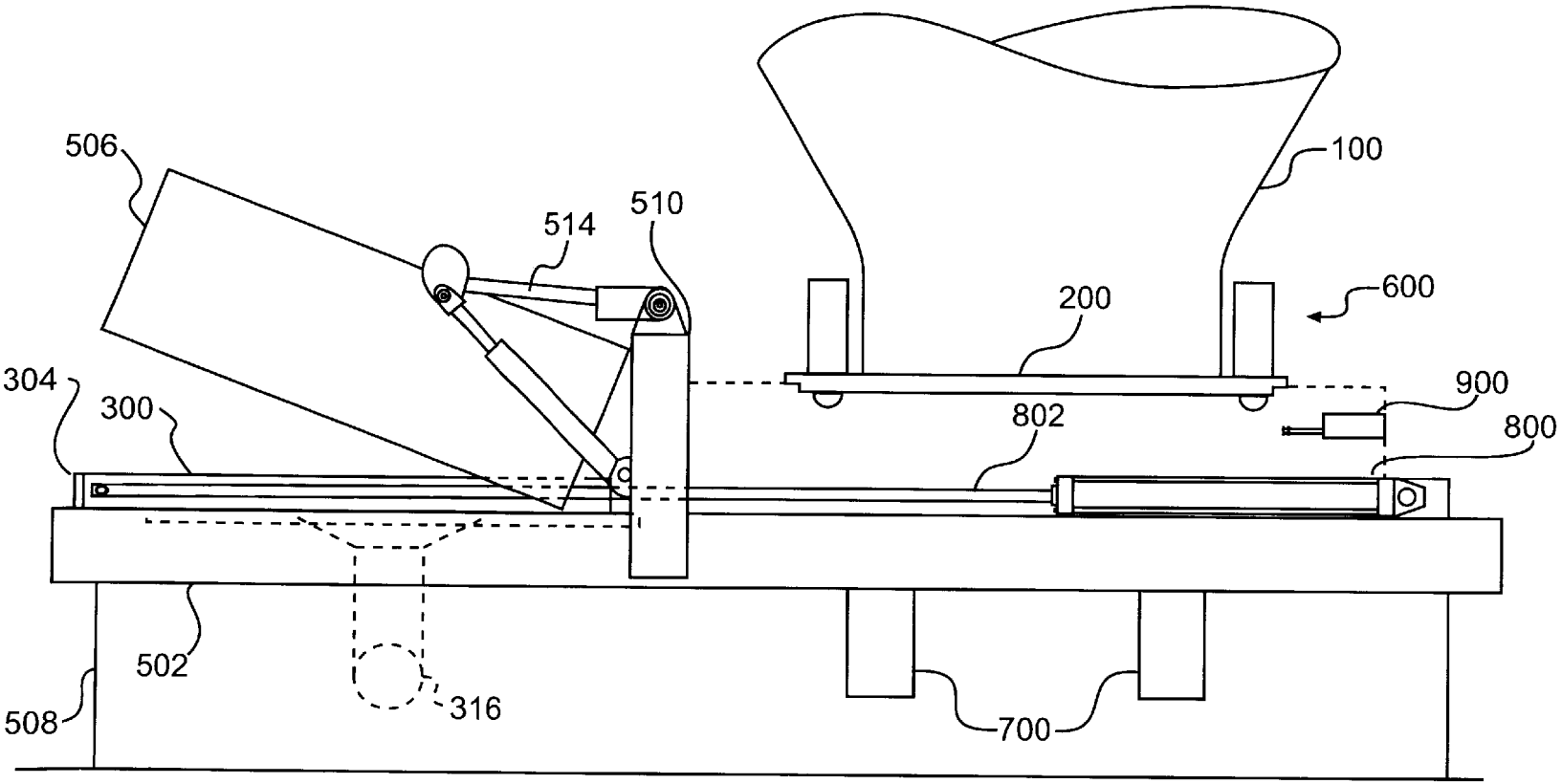
FIG. 19 is an elevation view showing the hood raised to permit cleaning of the cover.

Lastly, as FIG. 19 illustrates, if desired, and after all of the drums contents, including the coke, have been removed, the hood 506 may be tilted by the actuator assembly 514 about the hinges 507 to gain access to the cover 300 for cleaning. In this position, it is also possible (and usually desirable) to replace the gasket between the cover 300 and the flange 200.

It should be appreciated that throughout the unheading operation the removable cover 300 remains within the chassis 500. In addition, it is to be understood that to head the drum 100, the aforesaid operations are performed in reverse order.

While the present invention has been described with respect to what are at present considered to be the preferred embodiments, it should be understood that the invention is not limited to the disclosed embodiments. To the contrary, as exemplified above, the invention is intended to cover various modifications and equivalent arrangements included within the spirit and scope of the appended claims. For example, rather than employing hydraulic pressure to actuate the pistons and/or move the lock plate, various mechanical drive mechanisms can be used instead, as will be appreciated by those skilled in the art. Additionally, the inventive closure mechanism can be employed in other environments, such as autoclaves or other pressure vessels. Therefore, the scope of the following claims is intended to be accorded the broadest reasonable interpretations so as to encompass all such modifications and equivalent structures and functions.

We claim:

1. A pressure vessel unheading and containment system for removing a cover from a pressure vessel in an unheading operation, said system comprising:

an unheading apparatus including a cover removably secured to the pressure vessel and a lock plate cooperating with said cover, and a cover moving mechanism capable of moving said cover vertically and laterally; and a modular enclosure mechanism including a chassis and substantially enclosing said cover during the unheading operation, said chassis being adapted to support said cover during the unheading operation, said chassis being adapted to support said cover during the unheading operation.

2. The system according to claim 1, wherein said cover moving mechanism includes at least one vertically-oriented actuator to move said cover vertically.

3. The system according to claim 1, wherein said chassis includes a tiltable hood, said hood being tiltable relative to said chassis from a closed position to an open position.

4. The system according to claim 1, wherein said chassis includes a skirt adapted to extend through an unheading deck to confine discharges from the pressure vessel.

5. The system according to claim 1, wherein said cover moving mechanism includes at least one horizontally-oriented actuator to move said cover laterally and guide rails disposed within said enclosure mechanism to slidably support said cover.

6. The system according to claim 5, wherein said cover includes at least one projection adapted to engage said horizontally-oriented actuator.

7. The system according to claim 1, wherein the unheading apparatus further comprises a flange mounted to a headed end of the pressure vessel, said flange having a plurality of fasteners cooperating with said lock plate to secure said cover to the pressure vessel when said cover is brought into aligned contact with said flange.

8. The system according to claim 7, further comprising means for supporting said chassis from said flange.

9. The system according to claim 7, wherein said fasteners include a plurality of actuators for extending and retracting bolts therefrom.

10. The system according to claim 9, wherein said bolts include a head at one end and each being slidably attached to an actuator at the other end, and wherein said lock plate includes a plurality of holes, the holes having (i) a wider portion through which said bolt head can pass and (ii) a narrower portion through which the bolt head cannot pass, said lock plate being movable between a first position, in which the narrower portions of the holes are aligned with said bolts, and a second position, in which the wider portions of the holes are aligned with said bolts.

11. The system according to claim 10, wherein said cover has througholes dimensioned and located to allow said bolts to extend therethrough when said cover is brought into aligned contact with said flange.

12. The system according to claim 10, further comprising a lock plate moving mechanism capable of moving said lock plate laterally.

13. The system according to claim 12, wherein said lock plate moving mechanism comprises at least one horizontally-oriented actuator adapted to move said lock plate laterally between the first and second positions.

14. The system according to claim 13, wherein said horizontally-oriented actuator includes a rod, and said lock plate includes slots adapted to removably engage said rod when said cover is lifted into contact with the pressure vessel.

15. A pressure vessel unheading and containment system, comprising:

a removable cover closing a pressure vessel bottom outlet; and a chassis substantially enclosing an area between the bottom outlet and through an unheading deck, with said cover contained within the enclosed area in an open position and a closed position, wherein said chassis includes a hood that is movable relative to a portion of said chassis from a closed position to an open position.

16. The system according to claim 15, wherein the hood is tiltable relative to said chassis from said closed position to said open position.

17. The system according to claim 15, wherein said chassis includes a skirt adapted to extend through said unheading deck to confine discharges from the pressure vessel during an unheading operation.

18. A system according to claim 15, further comprising:

a flange mounted to the pressure vessel at the bottom outlet; and a lock plate cooperatively connected to said cover, with said flange and said lock plate cooperating to secure said cover to the bottom outlet.

19. The system according to claim 18, further comprising a plurality of fasteners mounted on said flange and cooperating with said lock plate to secure said cover to the pressure vessel when the cover is brought into aligned contact with said flange.

20. The system according to claim 19, wherein said fasteners include a plurality of actuators for extending and retracting bolts therefrom.

21. The system according to claim 20, wherein said bolts include a head at one end and each being slidably attached to an actuator at another other end, and wherein said lock plate has a plurality of holes, the holes having (i) a wider portion through which said bolt head can pass and (ii) a narrower portion through which said bolt head cannot pass, said lock plate being movable between a first position, in which the narrower portions of the holes are aligned with said bolts, and a second position, in which the wider portions of the holes are aligned with said bolts.

22. The system according to claim 21, wherein said cover has througholes dimensioned and located to allow said bolts to extend therethrough when said cover is brought into aligned contact with said flange.

23. The system according to claim 21, further comprising a lock plate moving mechanism capable of moving said lock plate laterally between the first and second positions.

24. The system according to claim 23, wherein said lock plate moving mechanism comprises at least one horizontally-oriented actuator to move said lock plate laterally.

25. The system according to claim 24, wherein said actuator includes a rod, and said lock plate includes slots adapted to removably engage said rod when said cover is lifted into contact with the pressure vessel.

26. The system according to claim 15, further comprising a cover moving mechanism capable of moving said cover vertically and laterally.

27. The system according to claim 26, wherein said cover moving mechanism includes at least one vertically-oriented actuator to move said cover vertically.

28. The system according to claim 26, wherein said cover moving mechanism includes at least one horizontally-oriented actuator to move said cover laterally and guide rails disposed within said chassis to slidably support said cover.

29. The system according to claim 28, wherein said cover includes at least one projection adapted to engage said horizontally-oriented actuator.

30. A pressure vessel unheading and containment system, comprising:

unheading means for unheading a cover from a bottom outlet of the pressure vessel; and enclosure means for substantially enclosing an unheading operation performed by said unheading means, wherein said enclosure means comprises a chassis that is adapted to support the cover during the unheading operation.

31. The system according to claim 30, wherein said chassis is adapted to be supported by a flange on the pressure vessel and substantially enclosing an area to confine the cover during the unheading operation.

32. The system according to claim 30, further comprising cover moving means adapted to move the cover vertically.

33. The system according to claim 32, wherein said cover moving means comprises at least one vertically-oriented actuator and at least one horizontally oriented actuator.

34. The system according to claim 30, wherein said unheading means comprises a removable cover, a lock plate cooperating with said cover, and a cover moving mechanism capable of moving said cover vertically and laterally.

35. The system according to claim 34, further comprising a flange mounted to the pressure vessel at its bottom outlet, said flange having a plurality of fasteners cooperating with said lock plate to secure the cover to the pressure vessel.

36. The system according to claim 34, wherein said unheading means includes a lock plate moving mechanism capable of moving said lock plate laterally.

* * * * *

UNITED STATES PATENT AND TRADEMARK OFFICE

CERTIFICATE OF CORRECTION

PATENT NO. : 6,751,852 B2
APPLICATION NO. : 09/852622
DATED : June 22, 2004
INVENTOR(S) : Allen S. Malsbury et al.

It is certified that error appears in the above-identified patent and that said Letters Patent is hereby corrected as shown below:

COLUMN 10:

Line 52, "operation, said chassis" should read -- operation. --.

Lines 53-54 should be deleted in their entirety.

Signed and Sealed this

Thirtieth Day of January, 2007

JON W. DUDAS

*Director of the United States Patent and Trademark Office*

UNITED STATES PATENT AND TRADEMARK OFFICE

CERTIFICATE OF CORRECTION

PATENT NO. : 6,751,852 B2
APPLICATION NO. : 09/852622
DATED : June 22, 2004
INVENTOR(S) : Allen S. Malsbury et al.

It is certified that error appears in the above-identified patent and that said Letters Patent is hereby corrected as shown below:

COLUMN 10:

Line 52, "operation, said chassis" should read -- operation. --.

Lines 53-54 should be deleted in their entirety.

Signed and Sealed this

Twentieth Day of February, 2007

JON W. DUDAS

*Director of the United States Patent and Trademark Office*